US006719178B1

(12) United States Patent
Taylor

(10) Patent No.: US 6,719,178 B1
(45) Date of Patent: Apr. 13, 2004

(54) CHEST-MOUNTED PAINT CARRIER

(76) Inventor: Robert Lee Taylor, 747-54th St., Apt. 6, Oakland, CA (US) 94609

( * ) Notice: Subject to any disclaimer, the term of this patent is extended or adjusted under 35 U.S.C. 154(b) by 0 days.

(21) Appl. No.: 09/710,044

(22) Filed: Nov. 8, 2000

(51) Int. Cl.[7] ..... A45F 3/16

(52) U.S. Cl. ..... 224/148.7; 224/197; 224/605; 224/623; 224/625; 224/271

(58) Field of Search ..... 224/148.1, 148.7, 224/197, 603, 604, 605, 623, 624, 625, 626, 647, 271, 272, 257–259, 148.4

(56) References Cited

U.S. PATENT DOCUMENTS

| | | | | | |
|---|---|---|---|---|---|
| 1,109,161 | A | * | 9/1914 | Chindgren | 217/28 |
| 1,178,628 | A | * | 4/1916 | Clawson | 224/259 |
| 1,504,927 | A | * | 8/1924 | Baust | 224/197 |
| 2,441,115 | A | * | 5/1948 | Lambert | 224/259 |
| 2,753,094 | A | * | 7/1956 | Haney, Jr. | 224/197 |
| 2,945,614 | A | * | 7/1960 | Wittmann, Sr. | 224/603 |
| 3,283,971 | A | * | 11/1966 | Jones | 224/148.7 |
| 3,380,635 | A | * | 4/1968 | King | 224/148.5 |
| 3,797,717 | A | | 3/1974 | Collins | |
| 3,878,589 | A | | 4/1975 | Schaefer | |
| 3,997,092 | A | | 12/1976 | Pogwizd | |
| 4,172,542 | A | | 10/1979 | Lankford | |
| 4,325,503 | A | | 4/1982 | Swinney | |
| 4,363,433 | A | | 12/1982 | Jaques | |
| 4,433,801 | A | | 2/1984 | Swinney | |
| 4,527,720 | A | | 7/1985 | Hayes | |
| D286,949 | S | | 12/1986 | Hardman | |
| 4,718,586 | A | | 1/1988 | Hagino | |
| 4,746,042 | A | * | 5/1988 | King | 224/148.2 |
| D296,268 | S | | 6/1988 | Bozarth | |
| 4,972,982 | A | | 11/1990 | Harbour | |
| 5,016,791 | A | | 5/1991 | Burow | |
| 5,163,591 | A | | 11/1992 | Leiserson et al. | |
| D344,852 | S | | 3/1994 | McManaman | |
| 5,320,342 | A | | 6/1994 | Houck | |
| 5,385,281 | A | | 1/1995 | Byrd | |
| 5,489,051 | A | | 2/1996 | Robinson | |
| 5,490,618 | A | | 2/1996 | Davidson | |
| 5,497,921 | A | | 3/1996 | Dancyger et al. | |
| 5,695,098 | A | | 12/1997 | King | |
| 5,730,339 | A | | 3/1998 | Stolfo | |
| 5,787,317 | A | | 7/1998 | Robinson, Sr. | |
| 5,915,606 | A | | 6/1999 | Jensen | |
| 6,006,966 | A | | 12/1999 | Voisin, Jr. | |
| 6,283,345 | B1 | * | 9/2001 | Butschat | 224/148.4 |

* cited by examiner

*Primary Examiner*—Nathan J. Newhouse
(74) *Attorney, Agent, or Firm*—Beeson Skinner Beverly, LLP; Brian Beverly

(57) ABSTRACT

A chest-mounted paint carrier and method for painting comprises a low profile paint receptacle depending from a mounting plate positioned at a painter's chest level, the paint receptacle hinged and pivoted from the mounting plate such that it is maintained in an upright position at all times, the receptacle having a lower dimension extending not below the painter's waist for ergonomic and efficient placement of the paint receptacle and improved access to the paint. A new method of painting using a chest-mounted paint carrier increases freedom of movement and frees both hands of the painter for other uses.

22 Claims, 6 Drawing Sheets

22
16
14
20
10
12

FIG._5A
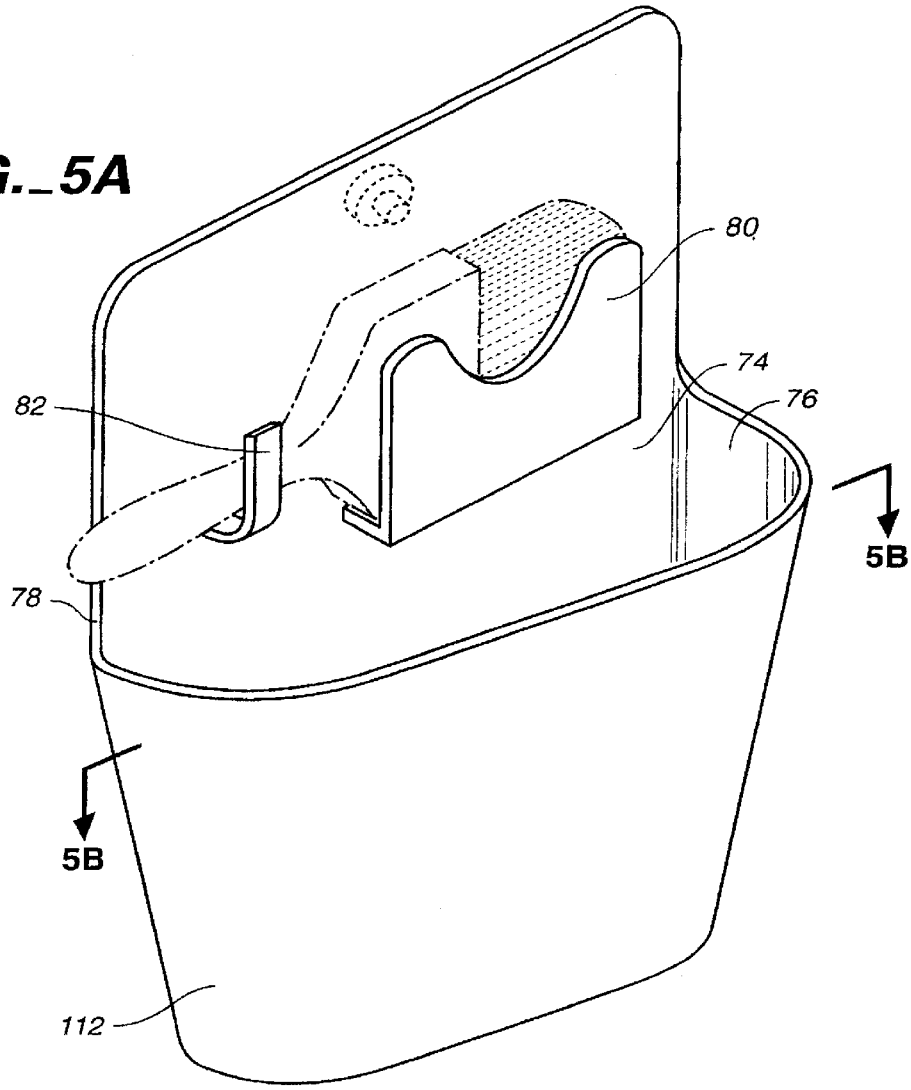
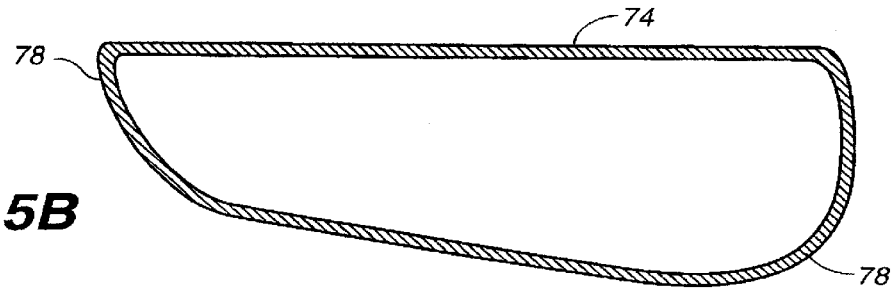
FIG._5B

CHEST-MOUNTED PAINT CARRIER

FIELD OF INVENTION

This invention relates to a paint carrier mounted at chest level for carrying a quantity of paint, and to a method of painting using a paint carrier mounted at chest level, the paint carrier and method retaining the benefits of prior art apparatuses and methods for carrying a measure of paint around a job site with the painter, but improving on the prior art by freeing the painter's hands and increasing physical mobility.

BACKGROUND OF INVENTION

The architectural application of paint and other protective coatings is an ancient art. Yet paint is still usually carried by hand in a bucket or pail. The painter ordinarily places a measure of paint in a paint container with a handle attached and carries the container around about the job. The almost universal method then is to carry the paint from place to place with the bucket in one hand and the brush in the other. The painter normally places the container on any convenient surface along the way, moving the container as the painting progresses. Moving the paint container around the job is tedious, exasperating, and can at times become dangerous, such as when climbing ladders and traversing scaffolding.

Numerous improvements have been made in the art attempting to free the painter's hands. A number of these improvements concentrate on placing a paint container on the front of the user, much like a peanut vendor at the ballpark. Notable among these are Pogwizd U.S. Pat. No. 3,997,092, Lankford, U.S. Pat. No. 4,172,542, Bozarth, U.S. Pat. No. Des. 296,268, Harbouir, U.S. Pat. No. 4,972,982, McManaman, U.S. Pat. No. Des. 344,852, Byrd, U.S. Pat. No. 5,385,281, and Jensen, U.S. Pat. No. 5,915,606. Pogwizd, for example, discloses a paint container carrier having a contoured shape to conform to the painter's body, including straps to secure the device in front of the user. Lankford discloses a sign painter's paint holder which disposes a paint case in front of the painter's torso at hip height.

A majority of designs place the paint container on the waist at the side of the user, like a tool holster. Included among these are Swinney, U.S. Pat. No. 4,325,503, Hayes, U.S. Pat. No. 4,527,720, Burow, U.S. Pat. No. 5,016,791, Hardman, U.S. Pat. No. Des. 286,949, Lieserson, U.S. Pat. No. 5,163,591, Robinson, U.S. Pat. No. 5,489,051, Davidson, U.S. Pat. No. 5,490,618, Dancyger, U.S. Pat. No. 5,497,921, Jaques, U.S. Pat. No. 4,363,433, Stolfo, U.S. Pat. No. 5,730,339, and Voisin, Jr., U.S. Pat. No. 6,006,966. For instance, Swinney describes a belt-on holder for securing a brush and paint bucket at the side of a painter's body at hip level. Hayes discloses a paint can holder for suspension from a painter's belt having a supporting means for holding a paint can by its bail. Similarly, Burow discloses a hip girdle to which a paint pail is secured by straps.

As can be seen, many patents for hands-free paint carriers are designed around the standard paint can. The resulting designs are bulky and reduce the painter's clearance by extending his or her profile. Furthermore, prior art devices designed to carry the paint can on the job are limited to one of two locations on the body for carrying: in front of the torso at waist level, or on the side at hip level. The resulting placement of the paint can by these devices does not account for the most natural and ergonomic construction of the body, leaving the painter with an unnecessarily reduced range of movement. For example, crawling along the floor to cut paint in at the base board is problematic because bulky prior art devices protrude into the work area when the painter is in a crouched work position and access to the paint is limited due to awkward body positions. Also, it is not uncommon for painters to find themselves leaning or hanging in precarious positions to reach particular areas while painting. The radical alignment of the body relative to the carrier resulting from prior art devices together with the added weight of the paint can and carrier can produce instability and perhaps introduce new dangers. A further disadvantage of the belt-attached devices is that they require the painter to strain wrist and shoulders to access the paint, and generally force the painter to come to an upright position to access the paint. Finally, all the prior art cited requires the painter to look where the brush is being aimed to ensure that it enters the paint container.

As the carrier device is changed to move the paint can toward the front of the painter, the above-stated disadvantages are mitigated, but the wearer is still fretted with inconveniences. Front clearance is reduced dramatically, any movement can easily induce spillage; the painter is hampered in leaning forward; and the painter must physically support the weight of the paint can thereby creating back strain.

On a normal painting job, it is customary and prudent to pour a measure of paint out of a full paint can into a receptacle for carrying around the job. This reduces the weight of the paint being carried and ensures against spillage. It is therefore unnecessary and disadvantageous to use the standard paint can as the on-the-job paint-carrying receptacle.

A few efforts have been made to introduce improved paint carriers. Robinson, supra, discloses a painter's pouch for carrying paint and paint application related tools suspended from the hip. Jaques, supra, describes a painter's holster for holding a reservoir of paint about the painter's waist. And, King, U.S. Pat. No. 5,695,098, discloses a safety paint bucket for attachment either to a belt or for suspension at belt level from a shoulder strap. These inventions, although not designed around carrying or holding a standard paint can, still suffer from inherently bulky designs and are maladapted to ergonomic efficiency.

There is accordingly a need to make conveniently available a measure of paint to the painter with a device that frees up the painter's hands for other uses, is convenient and easy to use, reduces any restrictions on the painter's movement to a minimum, and does not unduly expand the painter's physical profile while moving about the job. Ideally, any such device or method should allow for these attributes to be consistent with all but the most radical positions painters encounter, such as lying on their backs or stomachs.

SUMMARY OF THE INVENTION

The present invention provides an improved paint carrier which overcomes the above-stated disadvantages in the prior art. A chest-mounted paint carrier provides a shallow frontal profile paint carrier worn at the painter's chest in a convenient position for access to paint in the carrier, which minimizes restrictions on movement while freeing the painter's hands for other more efficient uses.

A chest-mounted paint carrier according to the invention provides a paint receptacle mounted to a mounting plate worn at chest level. In the preferred embodiment, the mounting plate is secured in place with a strap assembly. The receptacle is removably attached to the mounting plate with a pivot pin which allows the container to swing freely from side to side. A hinge below the pivot pin allows the container to swing forward and away from the torso when the painter has occasion to bend forward. The capacity of the paint receptacle anticipates and allows for carrying of a quantity of paint consistent with that usually carried when paint is poured from a paint can into a bucket for carrying around a job site. In the preferred embodiment, a paint brush may be suspended with its bristles above the carrier using a spring clip mounted on a back plate extending above the carrier.

Preferably, the paint receptacle depends from the mounting plate which is positioned at one side of the chest. The off-center location of the mounting plate and the unobtrusive profile of the paint receptacle combine to provide a paint container in a convenient and felicitous position for accessing the paint much as a portrait artist maintains a palette of paints for quick and easy access thereto.

The ergonomic placement of the paint receptacle on one side of the chest combined with the hinged and pivoting mounting apparatus enables the paint receptacle to swing freely in all directions thereby keeping it in an upright position, minimizing spillage, and allowing the painter to engage in various bending, stooping and crawling movements without interfering with ready access to the paint. The painter thus enjoys heretofore unknown freedom of movement and function.

The device allows the pivot pin to be dropped securely in place into the mounting plate and is disengaged merely by lifting the pivot pin up from and out of the mounting place. The painter thus can refill the receptacle using minimal effort and time. The ease of removing and replacing the receptacle on the mounting plate significantly increases the productivity of the painter.

The present invention thus provides an ergonomic, highly efficient device which assures that the paint receptacle at all times remains in a position relative to the painter that optimizes the painter's comfort and efficiency, that maintains a useful measure of paint in an upright and convenient position, and that is simple and inexpensive to manufacture. A new method of painting corresponding to the device maximizes a painter's freedom and range of movement.

Accordingly, it is a primary object of the invention to provide an improved paint carrier and method for painting which overcomes the disadvantages in the prior art.

It is a further object of the invention to provide an improved paint carrier and method for painting wherein a paint receptacle is mounted at a painter's chest level in depending relation from a mounting plate, freeing both hands of the painter for other uses.

It is an additional object of the invention to provide an improved paint carrier and method for painting using a paint brush or roller wherein a paint receptacle is mounted at a painter's chest level, the paint receptacle having a lowermost extent which remains above the painter's waist level, thereby placing the receptacle in an ergonomic, comfortable and efficient location for painting.

It is another object of the invention to provide an improved paint carrier and method for painting wherein the paint receptacle remains in an ergonomic position relative to the painter that optimizes the painter's comfort and efficiency.

It is still a further object of the invention to provide an improved paint carrier and method for painting wherein a low-profile paint receptacle is mounted at a painter's chest level in depending relation from a mounting plate, which minimizes the painter's physical profile while moving about a job site, and maintains the paint receptacle in a felicitous position for carrying paint and for painting.

It is another object of the invention to provide an improved paint carrier and method for painting using a paint brush or roller wherein a paint receptacle is mounted at a painter's chest level in depending relation from a mounting plate using a hinged and pivoting mounting apparatus which keeps the paint receptacle in an upright position at all times.

It is yet another object of the invention to provide an improved paint carrier which is inexpensive to manufacture.

BRIEF DESCRIPTION OF THE ILLUSTRATIONS

FIG. 5A is a perspective view of an alternative embodiment of a chest-mounted paint carrier according to the invention.

FIG. 5B is a section view of paint receptacle of the paint carrier of FIG. 5A taken along line 5B—5B of FIG. 5A.

DETAILED DESCRIPTION OF THE ILLUSTRATED EMBODIMENTS

Figure 1:
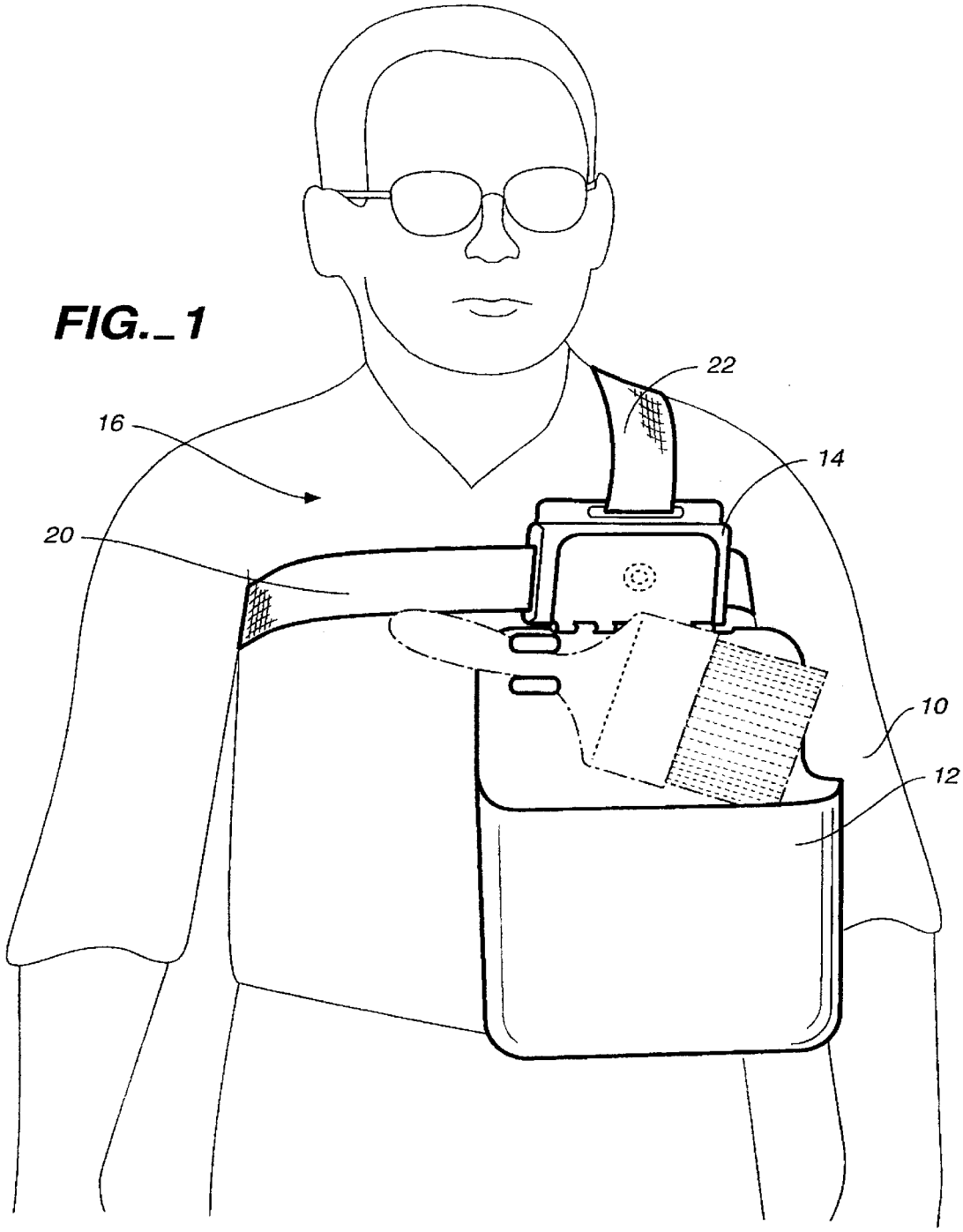
FIG. 1 is a frontal perspective view of a chest-mounted paint carrier according to the invention.

A chest-mounted paint carrier 10 is illustrated generally in FIG. 1. A paint receptacle 12 is attached to and depends from a mounting plate 14 securely positioned to a painter's chest. Securing means are provided for positioning the mounting plate 14 on the painter's chest. In the preferred embodiment seen in FIG. 1, the securing means comprises a strap assembly 16, shown in greater detail in FIG. 2. In an alternative embodiment, shown in FIG. 6, the securing means consists of a vest-mounting harness 18.

Figure 2:
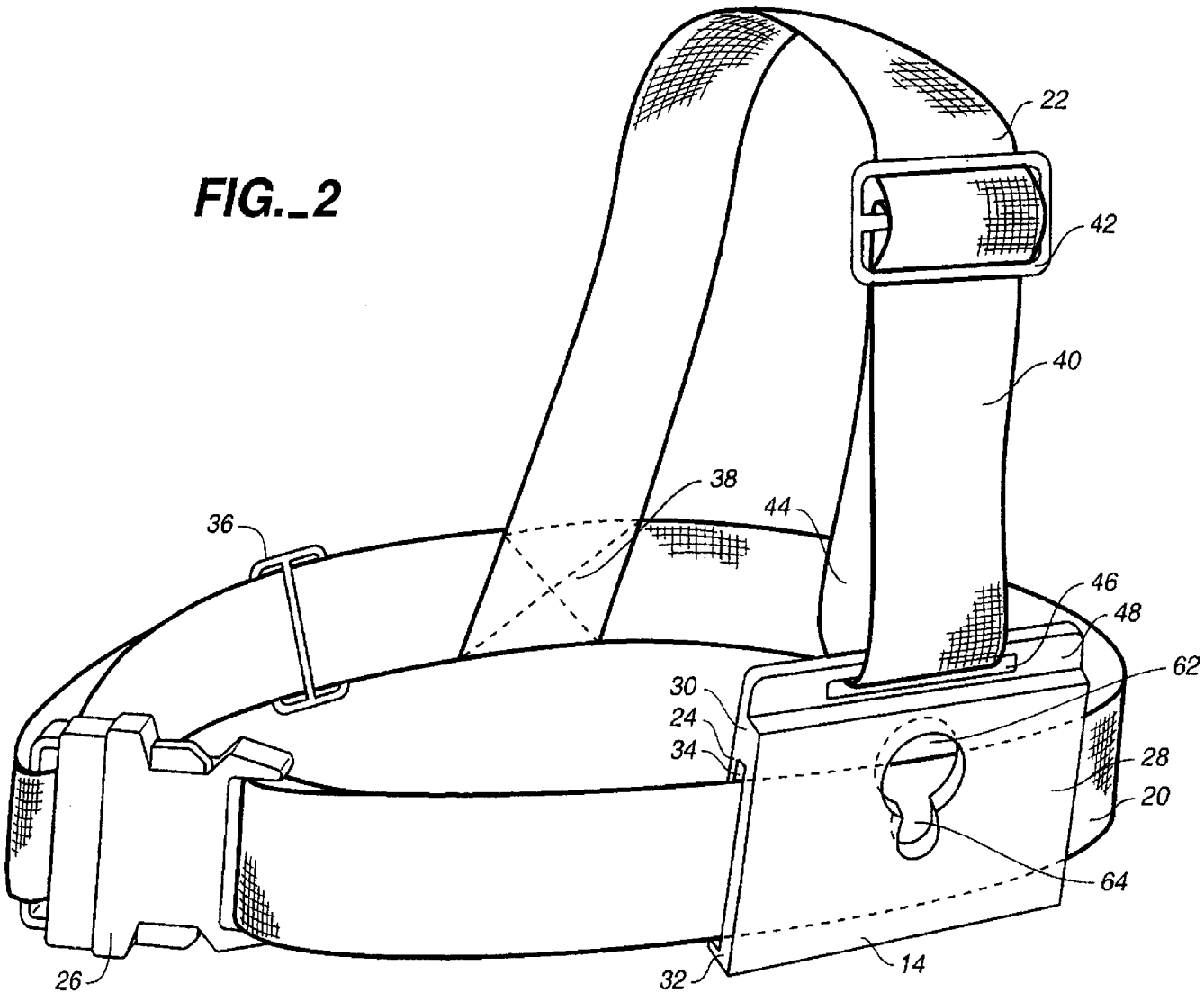
FIG. 2 is a perspective view of a mounting plate and strap assembly thereof.

Referring to FIG. 2, the strap assembly comprises mounting plate 14, chest strap 20, and shoulder strap 22. Chest strap 20 and shoulder strap 22 are primarily constructed of a rugged strap material such as nylon, but may incorporate portions of elastic for increased adjustability. Mounting plate 14 includes a base plate 24, and a face plate 28 joined to the base plate 24 at an upper edge 30 and bottom edge 32, the face plate 28, spaced from the base plate 24 forming a channel 34. Chest strap 20 passes through channel 34. Mounting plate 14 preferably is manufactured from polyethylene, but could be made from various rigid substances including numerous metals or even hardwoods.

Chest strap 20 includes buckle 26 in the preferred embodiment to allow chest strap 20 to be easily secured around the painter's chest. Preferably, chest strap 20 is provided with a pass-through buckle 36 to allow the length of the chest strap to be adjusted. In an alternative embodiment, buckle 26 is replaced with a hook-and-catch system, such as found on a carpenter's belt. Other embodiments include a double-bail system or a hole-and-tongue type buckle system, allowing the belt to be tightened or loosened. A rear portion 38 of shoulder strap 22 is affixed to the back part of chest strap 20, as shown in FIG. 2. A front portion 40 of shoulder strap 22 has a pass-through buckle 42 and loop 44 for varying the length of the shoulder strap 22. In alternative embodiments, the shoulder strap has a double-bail system or hole-and-tongue type buckle system for varying the length of shoulder strap 22. The loop 44 of shoulder strap 22 passes through a slot 46 in the top edge 48 of mounting plate 14. In normal usage, chest strap 20 is buckled around the chest with shoulder strap 22 passing over one of the painter's shoulders, thus positioning mounting plate 14 off-center on the painter's chest. Right-handed users will normally position mounting plate 14 off-center to the left. However, since mounting plate 14 is slidable over chest strap 20, a left-handed person can easily position mounting plate 14 on the right side of the chest.

Figure 3A:
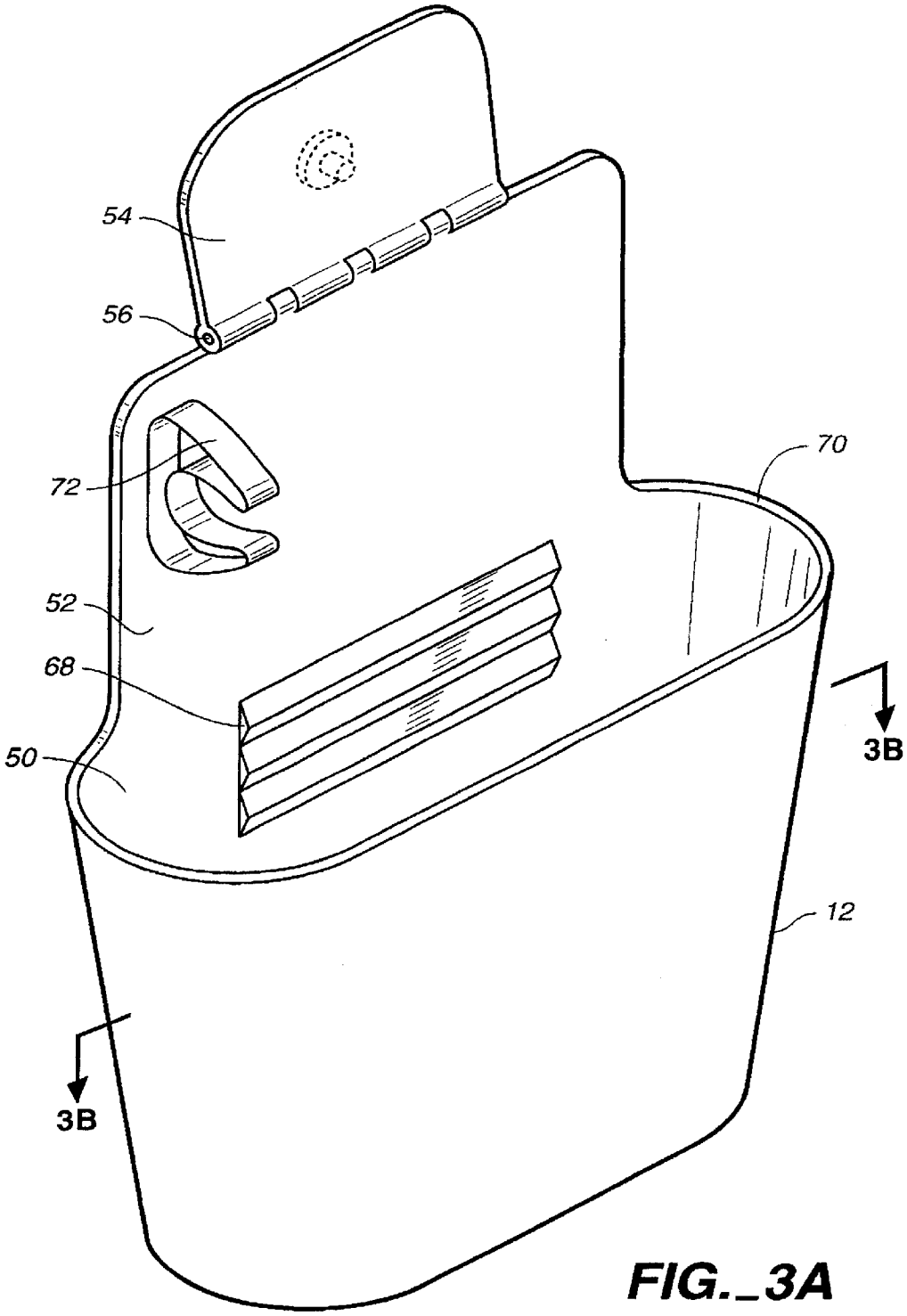
FIG. 3A is a perspective view of a paint receptacle and hinge plate of the paint carrier of FIG. 1.
Figure 4:
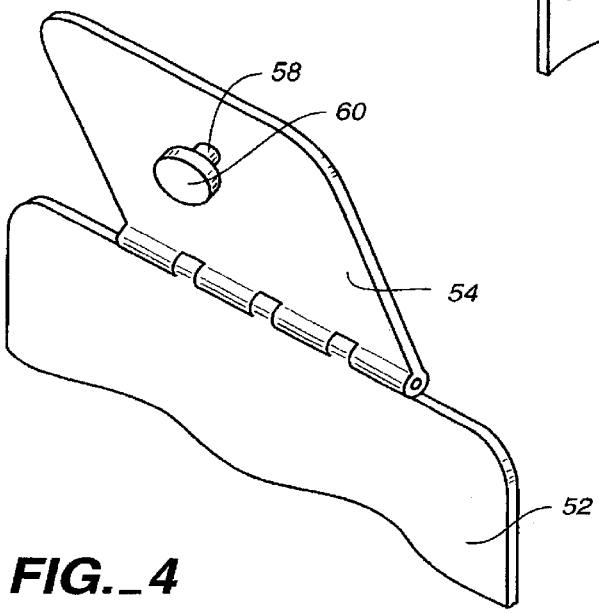
FIG. 4 is a rear perspective view of the hinge plate of FIG. 3A.

A paint receptacle 12 according to the invention is shown in FIG. 3A, and comprises paint well 50 and back plate 52 extending upwardly from the paint well 50. Paint receptacle 12 is connected to hinge plate 54 at hinge 56. Reference to FIG. 4 shows a pivot pin 58 projecting rearwardly from hinge plate 54 and having annular flange 60 spaced from hinge plate 54 a distance slightly greater than the thickness of the face plate 28 of mounting plate 14.

Referring back to FIG. 2, face plate 28 of mounting plate 14 includes opening 62 and a slot 64 extending downwardly from opening 62. Opening 62 is sized slightly larger than annular flange 60 of pivot pin 58, and slot 64 is slightly wider than pivot pin 58. Hinge plate 54 is mounted to the mounting plate 14 by inserting annular flange 60 through opening 62, then dropping pivot pin 58 into slot 64, thereby trapping annular flange 60 behind face plate 26 in channel 34. Paint receptacle 12, once mounted to mounting plate 14 via hinge plate 54, is free to swing about pivot pin 58 from side to side relative to the painter, and is also free to swing forward and away from the painter about hinge 56. In anatomical terminology, the mounted paint receptacle 12 pivots about a first axis, established by pivot pin 58, that is perpendicular to a coronal plane (a plane dividing the body into front and back parts) of a painter wearing the invention. The mounted paint receptacle 12 also pivots about a second axis, established by the pintle of hinge 56, that is perpendicular to a sagittal plane (one dividing the body into left and right parts) of the painter. The combination of the pivoting motion around pivot pin 58 and the back and forth motion allowed by hinge 56 allows paint receptacle 12 in practical situations to swing freely in all directions, maintaining it in an upright position, and all the while positioned ergonomically for the painter's convenient access to the paint. An unexpected benefit of this arrangement is that when the painter assumes bent-over or squat positions, the paint receptacle rotates approximately 45 degrees, fitting comfortably between the painter's legs and continuing to present the paint ergonomically to the painter. Although the hinged arrangement between the back plate and mounting plate provides the advantages as discussed above, an alternative embodiment of applicant's device dispenses with the hinge as seen in FIG. 5A.

Referring again to FIG. 3A, the paint container includes a plurality of ridges 68 disposed horizontally in the back of the paint well 50 for clearing paint from a paint roller. The painter may alternatively draw paint brush bristles across ridges 68 when withdrawing a paint brush from paint well 50 to remove excess paint, or across leading edge 70 of receptacle 12, before applying the brush to a surface. Applicant has determined that the peaks of ridges 68 should ideally form an angle of approximately 120 degrees. Use of a trim roller, especially for finish painting, is greatly facilitated by applicant's paint container.

Referring still to FIG. 3A, a spring clip 72 is provided for holding the handle of a paint brush or paint roller in the position shown in FIG. 1. Placement of the narrow part of a paint brush handle in the spring clip 72 will, for all normal-sized brushes or rollers, position the roller or the paint brush's bristles above the paint well 50, providing a convenient place for temporary storage of a wet paint brush or roller so that both hands may be freed for other uses. The spring clip is inexpensive to manufacture, readily available commercially, and easy to use.

Figure 3B:
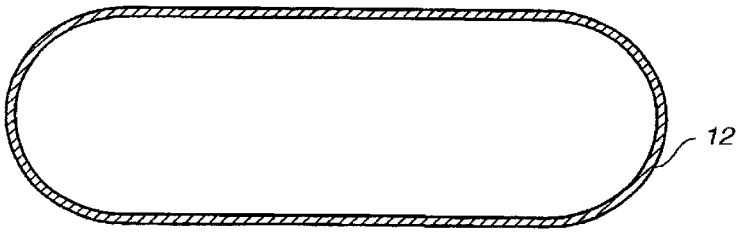
FIG. 3B is a section view of the paint receptacle of the paint carrier of FIG. 1 taken along line 3B—3B of FIG. 3A.

FIG. 3B shows a horizontal cross-section of the embodiment of the paint container shown in FIGS. 1 and 3. Preferably, receptacle 12 is in a generally oblong shape. However, the cross-sectional profile of receptacle 12 could be in myriad shapes, most likely with one side of the container extending out further to provide greater access to the paint well, but the anterior extent of the container generally should be shallow enough to minimize restriction of the painter's movement. Accordingly, in a container large enough to accommodate a conventionally useful measure of paint, the anterior dimension of paint receptacle 12 will be substantially less than its lateral width.

An alternative embodiment of a paint receptacle 112 according to the invention is illustrated in FIG. 5A. As seen in FIG. 5B, paint receptacle 112 has a horizontal cross-section characterized by flat back panel 74 and front portion extending out further frontally on a first side 76 than the other side 78.

An alternative embodiment of a paintbrush holding means is also shown in FIG. 5A. Brush cradle 80 provides support for a paintbrush while handle hook 82 holds the narrow part of a paintbrush handle. Brush cradle 80 and handle hook 82 provide the advantage of being able to gently slip a brush into a resting position above the paint well without having to snap the paintbrush into an out of a spring clamp, thereby minimizing the potential for paint splatter.

Figure 3C:
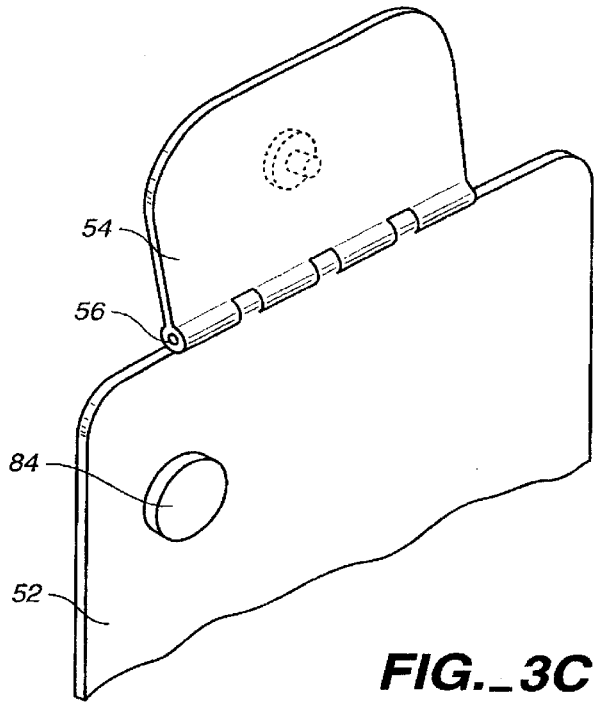
FIG. 3C is a sectional perspective view of a back plate and hinge plate of an alternative embodiment of a chest-mounted paint carrier according to the invention.

A third alternative embodiment of a paintbrush holding means is a magnet 84 as shown in FIG. 3C.

Figure 6:
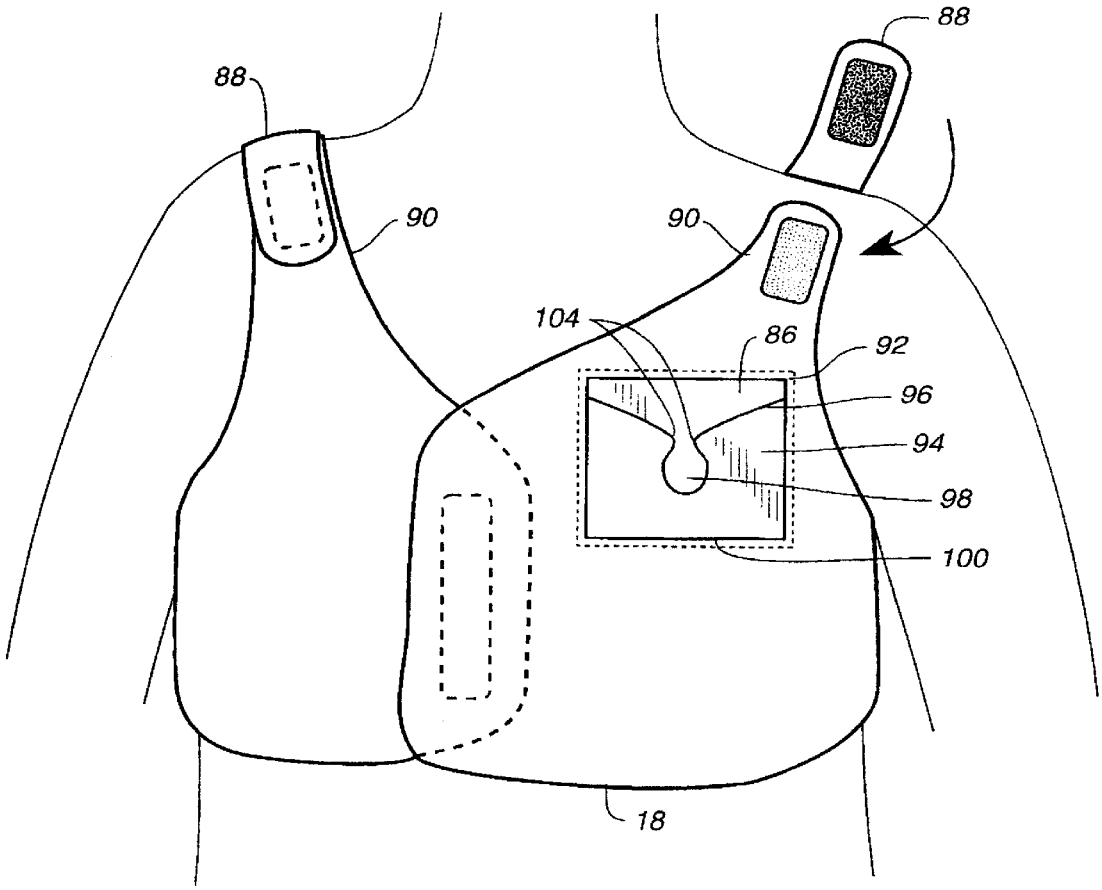
FIG. 6 is a front perspective view of a vest mounting harness according to the invention.

An alternative embodiment of securing means for securing mounting plate 14 at chest level is seen in FIG. 6, which illustrates vest mounting harness 18 and alternate mounting plate 86. Preferably the vest is constructed of lycra, but it could also be made of nylon, leather, canvas, or numerous other fabrics and materials known to those skilled in the art, so long as the material is substantial enough to support the attached mounting plate 86. Though not illustrated, if stiffer materials are used to make the vest, elastic material is incorporated therein, in gussets or otherwise, in a manner that is well known to those skilled in the art to make the vest fit more easily. The lycra vest embodiment includes overlapping shoulder straps 88 and front panels 90 fastened with a hook-and-loop-type fastener for adjustments to accommodate variations in users'torsos. Alternative mounting plate 86 is mounted at chest height on the vest 18. Mounting plate 86 is preferably stitched to vest 18, but also could also be glued, riveted, attached with a hook-and-loop-type fastener, or using numerous other attachment methods known to those skilled in the art. Mounting plate 86 comprises a back plate 92 and face plate 94. Instead of the keyhole style opening illustrated in FIG. 2, face plate 94 includes downwardly and inwardly sloping opposing upper edges 96. Central downwardly depending slot 98 conjoins upper edges 96. Face plate 94 and back plate 92 are joined at their respective coterminous lateral and bottom edges 100, but are spaced from each other a distance sufficient to accommodate annular flange 60 of pivot pin 58. Slot 98 has uppermost opposing lateral edges 104 which are spaced from each other slightly less than the width of pivot pin 58 sufficient to establish a resistance to passing pivot pin 58 through the opposing edges 104, but which yields to slight finger pressure. In normal usage of the embodiment illustrated in FIG. 6, the painter may place the paint receptacle on the floor, pour a desired measure of paint into the paint receptacle, lift the receptacle up to chest height, and drop annular flange 60 between back plate 92 and face plate 94 thereby capturing annular flange 60 between back plate 92 and face plate 94 and holding pivot pin 58 in slot 98.

There have thus been described and illustrated certain preferred embodiments of an improved paint carrier according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

I claim:

1. A paint carrier comprising:

a mounting plate having a substantially uniform planar geometry, a strap assembly for securing said mounting plate against a painter's chest, said strap assembly including a chest strap for encircling the painter's torso at chest level, said mounting plate attached to said chest strap, and a shoulder strap for passing over a shoulder of the painter, said shoulder strap having a rear portion and a front portion, said rear portion affixed to a back part of said chest strap, and said front portion having means for varying the length of said shoulder strap, said length varying means fixed to said mounting plate.

a hinge plate, and pivoting means for pivoting attachment of said hinge plate to said mounting plate about a pivot axis substantially perpendicular to said planar geometry of said mounting plate such that said hinge plate is disposed against and in pivoting relation to said mounting plate, a paint receptacle having a back plate, said back plate having a top edge hingedly connected to said hinge plate about a hinge axis substantially perpendicular to said pivot axis, said hinge axis disposed in substantially the same plane as said mounting plate, such that, when said mounting plate is secured against a painter's chest, said hinge plate pivots relative to said mounting plate adjacent the painter's chest and said paint receptacle depends from and swings about said hinge axis adjacent the painter's chest.

2. The paint carrier of claim 1 wherein:

said paint receptacle has an anterior profile substantially shallower than a lateral width thereof.

3. The paint carrier of claim 1 wherein:

said paint receptacle includes a front plate, and opposite side walls joining said front and back plates, said front plate and said side walls forming a contiguous upper periphery defining a top opening of said paint receptacle, and said back plate extends upwardly from said top opening, such that said top opening of said paint receptacle is vertically spaced below said hinge axis.

4. The paint carrier of claim 3 wherein:

said hinge plate has a bottom edge, and said top edge of said back plate is hingedly connected to said bottom edge of said hinge plate about said hinge axis.

5. The paint carrier of claim 1 including:

a hinge, said paint receptacle hingedly connected to said hinge plate at said hinge, said hinge pivoting about an axis perpendicular to a sagittal plane respective to a painter.

6. The paint carrier of claim 5 wherein:

said hinge plate includes a lower edge, and said paint receptacle includes a front wall, an upwardly extending back plate, and a bottom portion, said front wall having a top edge, said back plate having an upper edge extending above said top edge of said front wall, said paint receptacle further having a depth between said top edge of said front wall and said bottom portion and having an anterior dimension between said front wall and said back plate, said depth being substantially greater than said anterior dimension for more effectively holding liquid paint in said paint receptacle, said lower edge of said hinge plate hingedly connected at said hinge to said upper edge of said back plate such that said hinge and said hinge plate are vertically spaced above said top edge of said front wall of said paint receptacle.

7. A paint carrier comprising:

a mounting plate, a strap assembly for securing said mounting plate on a painter's chest, said strap assembly including a chest strap for encircling the painter's torso at chest level, said mounting plate attached to said chest strap, and a shoulder strap for passing over a shoulder of the painter, said shoulder strap having a rear portion and a front portion, said rear portion affixed to a back part of said chest strap, and said front portion having means for varying the length of said shoulder strap, said length varying means fixed to said mounting plate, and a paint receptacle depending from said mounting plate.

8. The paint carrier of claim 7 wherein:

said chest strap of said strap assembly has means for adjusting the length of said chest strap.

9. The paint carrier of claim 8 wherein:

said means for adjusting the length of said chest strap includes a first sliding buckle and a loop of said chest strap, said loop adjustable in length, said first buckle slidingly affixed to said chest strap at one end of said loop.

10. The paint carrier of claim 7 wherein:

said mounting plate includes a top edge, and said length varying means of said shoulder strap comprises a loop of said strap, adjustable in length, said loop passing through a slot in said top edge of said mounting plate.

11. The paint carrier of claim 10 wherein:

said length varying means of said shoulder strap includes a second sliding buckle slidingly affixed to said shoulder strap at one end of said shoulder strap loop.

12. The paint carrier of claim 7 wherein:

said mounting plate has a base plate and a face plate, said face plate joined to said base plate at an upper edge and at a bottom edge thereof, said face plate spaced from said mounting plate to define a channel between said upper edge and said bottom edge for sliding passage therethrough of said chest strap, said paint receptacle has an upwardly extending back plate having an upper edge, said paint carrier further including a hinge plate having a lower edge, said hinge plate hingedly connected at said lower edge to said upper edge of said back plate, said hinge plate having a rearwardly projecting pivot pin, said pivot pin having an annular flange spaced from said hinge plate, and said face plate having an annular opening slightly larger than said flange of said pivot pin and a slot downwardly extending from said opening, said slot slightly wider than said pivot pin, said channel of said mounting plate at least deep enough to slidingly receive said chest strap and said flange of said pivot pin, such that said flange may be inserted through said opening of said face plate into said channel and moved downwardly for insertion of said pivot pin into said slot, thereby trapping said flange in said channel for pivoting attachment of said hinge plate to said mounting plate.

13. The paint carrier of claim 12 wherein:

said hinge plate pivots about an axis perpendicular to a coronal plane respective to the painter.

14. The paint carrier of claim 12 wherein:

said paint receptacle has an anterior profile substantially narrower than its lateral width.

15. The paint carrier of claim 14 wherein:

said paint receptacle is oblong-shaped in horizontal cross-section.

16. The paint carrier of claim 14 wherein:

said paint receptacle includes a plurality of ridges.

17. The paint carrier of claim 16 wherein:

said plurality of ridges are horizontal and each said ridge forms a protruding angle of approximately one hundred twenty degrees.

18. The paint carrier of claim 12 wherein:

said paint receptacle includes a paint well, and said back plate includes means for holding a paint brush with its bristles in superposing relation to said paint well.

19. The paint carrier of claim 18 wherein:

said means for holding a paint brush comprises a spring clamp.

20. A paint carrier comprising:

a mounting plate having a base plate and a face plate, said face plate joined to said base plate at an upper edge and at a bottom edge of said face plate, said face plate spaced from said mounting plate to define a channel between said upper edge and said bottom edge, a strap assembly, including a chest strap for encircling a painter's torso at chest level, said chest strap passing through said channel of said mounting plate, said strap assembly further including a shoulder strap for passing over a shoulder of the painter, said shoulder strap having a rear portion and a front portion, said rear portion affixed to a back part of said chest strap, said front portion having a loop, adjustable in length, said loop passing through a slot in a top edge of said mounting plate, said strap assembly positioning said mounting plate at chest level, a hinge plate having a rearwardly projecting pivot pin, said pivot pin having an annular flange spaced from said hinge plate, said face plate having an annular opening slightly larger than said flange of said pivot pin and a slot extending downwardly from said opening, said slot slightly wider than said pivot pin, said channel of said mounting plate at least deep enough to slidingly receive said chest strap and said flange of said pivot pin, such that said flange may be inserted through said opening of said face plate into said channel and moved downwardly for insertion of said pivot pin into said slot, thereby trapping said flange in said channel for pivoting attachment of said hinge plate to said mounting plate, said hinge plate pivoting about an axis perpendicular to a coronal plane respective to the painter, a paint receptacle having an upwardly extending back plate having an upper edge, said hinge plate hingedly connected at a lower edge thereof to said upper edge of said back plate, said back plate pivoting about an axis perpendicular to a sagittal plane respective to the painter, said paint receptacle having an anterior profile substantially narrower than its lateral width, and said back plate of said paint receptacle having a spring clamp for holding a paintbrush with its bristles in superposing relation to said paint receptacle.

21. A method for carrying paint comprising:

encircling a painter's torso at chest level with a chest strap, said chest strap having a back part, retaining a mounting plate on said chest strap, passing a shoulder strap over a shoulder of the painter, said shoulder strap having a rear portion and a front portion, and said front portion having means for varying the length of said shoulder strap, affixing said rear portion of said shoulder strap to said back part of said chest strap, fixing said varying means of said front portion of said shoulder strap to said mounting plate, mounting a paint receptacle in pivoting relation to and depending from said mounting plate for lateral pivoting action of said paint receptacle, said paint receptacle having an anterior profile substantially narrower than its lateral width, and said paint receptacle having a lowermost extent bounded approximately by the waist of a standing painter, and carrying paint in said paint receptacle.

22. The method of claim 21 including:

detachably holding a paint brush to an upwardly extending back plate of said paint receptacle such that the bristles of the paint brush are in superposing relation to said paint receptacle, and detaching with one hand the paint brush as needed for painting.

* * * * *